US007708208B1

(12) United States Patent
Scheer

(10) Patent No.: US 7,708,208 B1
(45) Date of Patent: May 4, 2010

(54) METHOD AND APPARATUS TO DISINTEGRATE LIQUIDS HAVING A TENDENCY TO SOLIDIFY

(76) Inventor: Ingo Werner Scheer, 6455 La Jolla Blvd., La Jolla, CA (US) 92037

( * ) Notice: Subject to any disclaimer, the term of this patent is extended or adjusted under 35 U.S.C. 154(b) by 665 days.

(21) Appl. No.: 11/541,833

(22) Filed: Oct. 2, 2006

(51) Int. Cl.

| | |
|---|---|
| ***B05B 17/04*** | (2006.01) |
| ***B05B 7/06*** | (2006.01) |
| ***B05B 15/02*** | (2006.01) |
| ***B05B 1/28*** | (2006.01) |

(52) U.S. Cl. ..... 239/1; 239/104; 239/112; 239/290; 239/423; 239/424

(58) Field of Classification Search ..... 239/1, 239/104, 106, 112, 113, 119, 120, 290, 294, 239/398, 418, 423, 424, 434.5
See application file for complete search history.

(56) References Cited

U.S. PATENT DOCUMENTS 4,631,055 A 12/1986 Redl et al.
5,915,625 A * 6/1999 Focke et al. ..... 239/112

* cited by examiner

*Primary Examiner*—Darren W Gorman

(57) ABSTRACT

A method and apparatus to disintegrate a liquid having a tendency to solidify and improving the operational safety of processes involving dispensing or spraying of small liquids amounts. The method of the present invention comprises the prevention of the formation of nozzle built-up of formerly suspended particles or formerly dissolved solute by means of closing the nozzle aperture when the spraying process is stopped using a sealing liquid.

21 Claims, 9 Drawing Sheets

METHOD AND APPARATUS TO DISINTEGRATE LIQUIDS HAVING A TENDENCY TO SOLIDIFY

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

Field of Invention

The present invention relates generally to a method and an apparatus for disintegration of small liquids amounts, and more particularly to an improved method which prevents simply and effectively clogging of a liquid dispensing or atomizing device due to drying and hardening of the process liquid.

BACKGROUND OF THE INVENTION

The present invention relates to a method and an apparatus for dispensing or atomizing small amounts of liquids having a tendency to solidify or dry out when exposed to atmospheric air.

In chemical, pharmaceutical and biomedical applications, such as chemical analysis of liquid samples and medical coating applications, there is a trend to use an apparatus to dispense and atomize a liquid also referred to as process liquid that tend to solidify and may also be of high viscosity. In its simplest form, such an apparatus will include means to supply the process liquid and a device for atomizing or dispensing the liquid, using for example ultrasonic, electrostatic and/or pneumatic means.

It is frequently desirable to employ an apparatus comprising a nozzle that is of a relatively small orifice diameter to disintegrate small liquid amounts. However, many liquids tend to solidify or dry out when exposed to atmospheric air, leaving behind a film of dried product on the sides of the nozzle orifice, which will tend to narrow the orifice, particularly as the build-up increases over time. As the dimension of the nozzle orifice is critical to produce the desired spray pattern, the spray pattern typically becomes more irregular and has larger and more unevenly sized liquid particles when the surface of the orifice become coated with dried product. In case of a dispensing operation, slight depositions at the orifice will generally adulterate the drop volume and result in variations of the volume of liquid supplied. Thus, the process will not be repeatable and requires time-consuming maintenance for readjusting the drop volume and eliminating the nozzle built-up.

It is known to perform preventative routine maintenance or a specific operational sequence including a start-up or a purging sequence to minimize nozzle built-up. However, cleaning cycles involving flushing the fluid line with a cleaning liquid and particle filters do not completely eliminate nozzle built-up. There is a risk that solid matter is still present, may get loose and leads to inhomogeneous droplet sizes and nozzle clogging. Even relatively short standstill periods may result in gas inclusions and crystallization or sedimentation of particles or components, which may cause malfunction or clogging of the apparatus and result in time-consuming cleaning procedures.

Other attempted solutions include covering the orifices using mechanical means when inactive. In addition, it may be required to dismount or move the nozzle during maintenance, which will often result in incorrect alignment of the nozzle in relation to the substrate.

In coating processes, such as drug coating of medical implants, it is necessary to accurately control the deposition of material on the object in order to ensure a homogeneous coating and a consistent coating weight. However, in prior art systems nozzle built-up and clogging often leads to poor performance of the atomizing or dispensing device resulting in expensive maintenance and coating defects. In addition, starting and stopping a spraying cycle, which may be desirable to reduce waste of hazardous and/or expensive material, may not be possible due to nozzle built-up and clogging. Thus, nozzle clogging can give rise to both quality and productivity problems.

OBJECT OF THE INVENTION

The principal aim of the present invention is to provide a new and improved method of disintegrating liquids, while preventing the crystallization and/or sedimentation of particles leading to nozzle clogging and the development of air bubbles or foreign matter.

One object is to provide a new and improved method of coating a substrate with liquids that tend to solidify without clogging when inactive allowing starting and stopping of a spraying process to minimize waste of hazardous and/or expensive coating material.

Another object is to provide a new and improved method to prevent nozzle clogging by wetting the liquid orifice during the state of spraying with a suitable solvent for the process liquid to prevent particle crystallization and/or sedimentation.

Yet another object of the present invention is to reduce maintenance time and costs and improve process repeatability by minimizing mounting and dismounting of the atomizer during extended system shut-down periods.

Yet another object of the present invention is to provide new and improved devices for carrying out the method of the present invention adapted to various methods, such as dispensing and atomization using pneumatic, ultrasonic or electrostatic means.

Other objects and advantages of the invention will become apparent from the description of the embodiments and the drawings and will be in part pointed out in more detail hereinafter.

The invention consists in the features of construction, combination of elements and arrangement of parts exemplified in the construction hereinafter described and the scope of the invention will be indicated in the appended claims.

SUMMARY OF THE INVENTION

The method and apparatus of the present invention were developed in response to the specific problems encountered with various apparatus for disintegration of small amounts of liquids. A system for spray coating medical implants is used as the model for description of the method and apparatus of the present invention that is intended to prevent the problem of nozzle clogging. Use of the spray coating system model is not intended to limit the applicability of the method to that field. It is anticipated that the invention can be successfully utilized in other circumstances, such as in the field of diagnostics for dosing and spraying of sample liquids or in pharmaceutical production processes including spray drying and microencapsulation.

The present invention comprises an improved method and apparatus of disintegrating relatively small amounts of a process liquid, such as a suspension or solution. In general, the method diverges from conventional methods by preventing clogging of the orifice due to different clogging mechanisms including crystallization, rapid evaporation of solvents, drying, and others and thereby ensuring a stable and repeatable liquid disintegration process. The method and apparatus of the present invention allows the nozzle to remain unclogged during spraying inactivity. In addition, conventional apparatus may be simplified using the present invention by eliminating the necessity of using purging or washing cycles, while improving operational safety and reliability of spraying and dispensing processes.

In one embodiment, an apparatus to disintegrate a process liquid into a plurality of fine droplets and to provide a sealing liquid to prevent nozzle clogging is provided. The apparatus comprises vibrating means to disintegrate the process liquid, a first liquid passage for the process liquid extending from a first inlet to a first orifice and a second liquid passage for the sealing liquid extending from a second inlet to a second orifice, wherein the first and the second liquid orifice are positioned in immediate vicinity to each other. Means to supply the process liquid to the first inlet, and means to supply the sealing liquid to the second inlet are provided. During the period of spraying inactivity an amount of sealing liquid sufficient to cover the first liquid orifice and to form a film is supplied via the second liquid orifice and before starting the spraying process the sealing liquid is removed.

In certain embodiments, the first and second liquid passages may be comprised in an external conduit and first and second orifices can be located in vicinity from the vibrating means. The apparatus may further comprise pneumatic means connected to the second liquid passage through which gas or sealing liquid may be supplied, wherein the first liquid passage may be positioned within the vibrating means and the second liquid passage may surround the vibrating means. The vibrating means may be an ultrasonic horn and the first liquid passage may be provided within the ultrasonic horn and the second liquid passage can be comprised in an external conduit positioned adjacent to the ultrasonic horn.

In another embodiment, an apparatus to dispense a process liquid and to provide a sealing liquid to prevent nozzle clogging is provided. The apparatus comprises a nozzle having a first liquid conduit for the process liquid extending from a first inlet to a first orifice and a second liquid conduit for the sealing liquid extending from a second inlet to a second orifice, means to supply the process liquid to the first conduit and means to supply the sealing liquid to the second conduit. First and second conduits are positioned such that one conduit surrounds the other and the first orifice is in immediate vicinity of the second orifice. During the period of dispensing inactivity an amount of sealing liquid sufficient to cover the process liquid orifice and form a film at the nozzle tip is supplied via the second liquid conduit such that solidification of the process liquid is prevented, and before starting the dispensing process the film of sealing liquid is removed by suction.

In certain embodiments, the first and second liquid conduits may be coaxially aligned and the second liquid conduit may surround the first liquid conduit.

In a further embodiment, an apparatus to disintegrate a process liquid into a plurality of fine droplets and to provide a sealing liquid to prevent nozzle clogging is provided. The apparatus comprises an atomizing nozzle having a first conduit to feed the process liquid extending from an liquid inlet to a first orifice and a second conduit to feed an atomizing gas and a sealing liquid extending from at least one fluid inlet to a second orifice located in immediate vicinity of the first orifice, means to supply the process liquid to the liquid inlet. In addition, means to supply an atomizing gas to the fluid inlet, and means to supply the sealing liquid to the fluid inlet are provided. During spraying inactivity an amount of sealing liquid sufficient to cover the first orifice and to form a film is supplied via the second conduit to the second orifice such that solidification of the process liquid is prevented and before starting the spraying process the sealing liquid is removed by feeding gas into the second conduit.

In certain embodiments, the liquid may be disintegrated using pneumatic means and the second conduit may surround the first conduit. The apparatus may further comprise a high voltage source coupled to the liquid conduit to disintegrate the liquid using electrostatic means.

In a next embodiment, an apparatus to disintegrate a process liquid into a plurality of fine droplets and to provide a sealing liquid to prevent nozzle clogging is provided. The apparatus comprises an atomizing nozzle having a first liquid conduit extending from a first inlet to a first orifice through which the process liquid is expelled and a second conduit extending from a second inlet to a second orifice, wherein the second orifice surrounds and is essentially coaxial with the first orifice. Furthermore, at least one additional conduit having an orifice for the sealing liquid positioned in immediate proximity to the first liquid orifice, means to supply the process liquid to the first inlet, means to supply a fluid to the second inlet, and means to supply the sealing liquid to the sealing liquid inlet are provided. During the period of spraying inactivity an amount of sealing liquid sufficient to cover the nozzle tip is supplied via the sealing liquid orifice such that a film is formed and solidification of the process liquid is prevented.

In certain embodiments, an amount of sealing liquid may be supplied during spraying activity to prevent solids built-up at the liquid orifice. The first liquid conduit may be further connected to a high voltage source to disintegrate the first liquid using electrostatic means.

In still another embodiment, a method is provided to spray a process liquid having a tendency to solidify or dry out and to provide a sealing liquid to prevent nozzle clogging, using an atomizing device having at least one orifice for a process liquid and at least one orifice for a sealing liquid positioned in immediate proximity to the process liquid orifice. The method comprises disintegrating the process liquid into a plurality of droplets, stopping the disintegration process and supplying a sealing liquid to form a film 100 to separate the process liquid orifice from the external atmosphere, maintaining the film during the period of spraying inactivity; and removing the sealing liquid before starting the spraying process.

In certain embodiments, the liquid to be atomized may comprise a therapeutic agent. The sealing liquid may be removed by atomization or by suction. The method may further comprise the step of providing during spraying activity a small amount of sealing liquid to prevent solids built-up.

In a further embodiment, a method is provided to spray coat a medical device with a process liquid having a tendency to solidify or dry out and to cover the process liquid orifice during inactivity of spraying with a sealing liquid to prevent nozzle clogging, using an atomizing device having at least one orifice for the process liquid and at least one orifice for the sealing liquid. The method comprises the steps of disintegrating the process liquid into a plurality of droplets and forming a spray plume, positioning the medical device in relation to the spray plume, stopping the coating process, supplying the sealing liquid from at least one orifice located in immediate vicinity of the process liquid orifice to form a film to separate the process liquid orifice from the external atmosphere, maintaining the film during the period of spraying inactivity and removing the sealing liquid before starting the coating process.

DRAWINGS

DETAILED DESCRIPTION OF THE DRAWINGS/PREFERRED EMBODIMENTS

Figure 1:
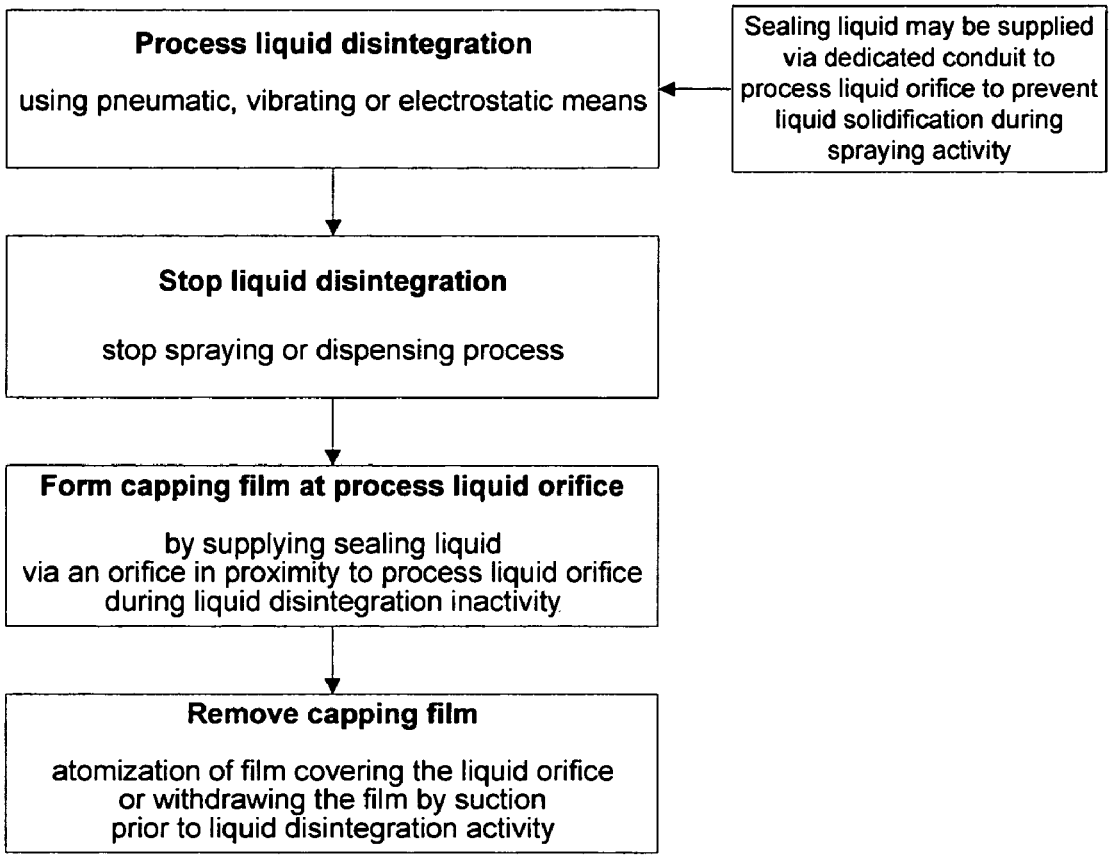
FIG. 1 is a flow chart illustrating the method of the present invention.

The present invention comprises an improved method of dispensing and/or atomizing a fluid that consists of a suspension or solution having a volatile liquid dispersion phase or medium, herein called a solvent, and a suspended or dissolved component that will precipitate in a solid phase when the solvent is reduced, for example by evaporation. The method of the present invention comprises the prevention of the formation of nozzle built-up of formerly suspended particles or formerly dissolved solute by means of closing the nozzle aperture when the spraying process is stopped using a sealing liquid compatible with the fluid to be atomized.

The process liquid or composition to be disintegrated may comprise a chemical and/or biological liquid. Preferably, a composition may be used comprising a polymer, a solvent and/or a therapeutic substance. For the sake of brevity, the term solvent is used to refer to any fluid dispersion medium whether a solvent of a solution or the fluid base of a suspension, as the invention is applicable in both cases. The therapeutic substance may include, but is not limited to, proteins, hormones, vitamins, antioxidants, DNA, antimetabolite agents, anti-inflammatory agents, anti-restenosis agents, anti-thrombogenic agents, antibiotics, anti-platelet agents, anti-clotting agents, chelating agents, or antibodies. Examples of suitable polymers include, but are not limited to, synthetic polymers including polyethylen (PE), poly(ethylene terephthalate), polyalkylene terepthalates such as poly(ethylene terephthalate) (PET), polycarbonates (PC), polyvinyl halides such as poly(vinyl chloride) (PVC), polyamides (PA), poly (tetrafluoroethylene) (PTFE), poly(methyl methacrylate) (PMMA), polysiloxanes, and poly(vinylidene fluoride) (PVDF); biodegradable polymers such as poly(glycolide) (PGA), poly(lactide) (PLA) and poly(anhydrides); or natural polymers including polysaccharides, cellulose and proteins such as albumin and collagen. The coating composition can also comprise active agents, radiopaque elements or radioactive isotopes. The solvent used for dissolving the process liquid is selected based on its biocompatibility and the solubility of the polymer.

Aqueous solvents can be used to dissolve water-soluble polymers, such as Poly(ethylene glycol) (PEG) and organic solvents may be used to dissolve hydrophobic and some hydrophilic polymers. Examples of suitable solvents include methylene chloride, ethyl acetate, ethanol, methanol, dimethyl formamide (DMF), acetone, acetonitrile, tetrahydrofuran (THF), acetic acid, dimethyle sulfoxide (DMSO), toluene, benzene, acids, butanone, water, hexane, and chloroform.

The sealing film, also referred to as capping liquid or cleaning liquid, is a material that is preferably compatible with the process liquid. Preferably, the sealing liquid comprises the same solvent 180 used in the process liquid. Other liquids such as higher viscosity liquids may also be used if they are compatible with the process liquid and don't cause contamination. The sealing or cleaning liquid may be applied to the liquid orifice of the dispensing or atomizing nozzle to seal the orifice during periods of inactivity or to wet the liquid orifice during the liquid disintegration process.

As shown in FIG. 1, the method of disintegrating a liquid having a tendency to solidify or dry out 185 when exposed to atmospheric air into a plurality of fine droplets comprises the following steps. Starting the spraying process to produce a plurality of droplets. During the spraying process a cleaning liquid may be supplied to prevent solid built-up. After the spraying process is being stopped, providing a sealing liquid film covering the process liquid orifice such that the process liquid orifice is separated from the external atmosphere. Before starting the liquid disintegration process, removing the sealing liquid film. The sealing liquid may be removed by atomizing it, for example using pneumatic or electrostatic energy or by applying a suction force to force the liquid back into a reservoir and prevent contamination of the spray area. Other suitable mechanism to withdraw the sealing liquid may also be provided.

The dispensing or atomizing device of the apparatus for such method comprises at least one liquid conduit for the process liquid having an inlet port and an outlet port through which the liquid is expelled, one or more conduits having one or more orifices in immediate vicinity to the first liquid orifice to supply the sealing liquid and means to supply sealing and process liquid in a controlled manner.

FIGS. 2-7 are representations of exemplary dispensing and/or atomizing devices of the apparatus of the present invention illustrating the liquid dispensing or atomization step and a sealing step during idle time. The devices comprise an orifice for the liquid to be dispensed or process liquid and one or more orifices for the sealing liquid. The sealing liquid orifice may be located coaxially with the process liquid orifice such that a capping film can be formed at the face of the process liquid orifice. Alternatively, the sealing liquid orifice may be positioned next to the process liquid tip. The angle between the axis of the process liquid orifice and the axis of the sealing liquid orifice may be smaller or equal to 90 degree and a second sealing liquid orifice may be provided as illustrated in FIG. 8. Also, the sealing liquid orifice can be located perpendicular and adjacent to the process liquid orifice. The sealing liquid may be fed for example by gravity, using a pump or a pressurized sealing liquid container. Depending on liquid type, length of idle time and environmental factors influencing the liquid evaporation rate the sealing liquid may be supplied on an intermittent basis or continuously to maintain the sealing film at the nozzle tip. When the sealing liquid is discharged, the sealing liquid contacts the face of the tip on which the sealing liquid is held by surface forces and a protecting film is formed. The film may cover the entire nozzle tip and may increase in thickness until reaching a hemispherical shape. To prevent dripping, the liquid supply should be controlled such that the surface force of the film is greater than the weight force of the film.

Referring now to FIG. 2, a simplified schematic representation of the front section of a dispensing tip of a dosing device is shown. The dispensing tip comprises a first liquid conduit 40 for the process liquid 4 extending to orifice 15 and a second liquid conduit 31 for the sealing liquid 30 having orifice 32 surrounding and coaxially aligned with the first conduit. The process liquid to be dispensed may be comprised in a supply container. The supply of the required quantity of liquid may be performed, e.g. by use of a micropump, via the dispensing tip.

Figure 2A:
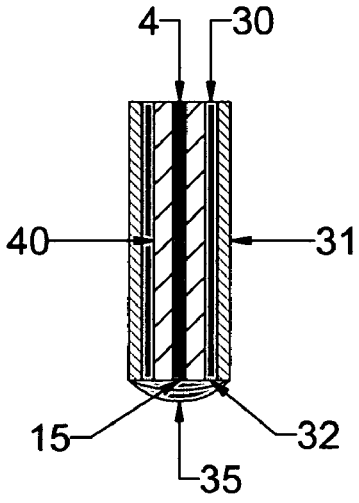
FIG. 2A is a schematic cross-sectional view of a dispense tip (covered liquid orifice/idle mode).
Figure 2B:
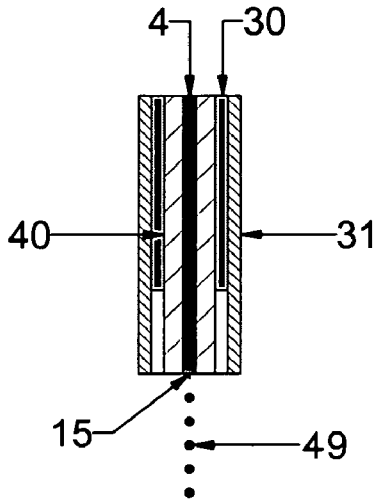
FIG. 2B is a schematic cross-sectional view of a dispense tip (open liquid orifice/dispensing mode).

As shown in FIG. 2A during idle time, the sealing liquid 30 is fed into the second conduit, expelled trough 220 orifice 32 and a sealing liquid film 35 covering liquid orifice 15 is provided. Thus, solidification of the process liquid 4 can be prevented. FIG. 2B depicts the dispensing cycle during which process liquid 4 is supplied and ejected through orifice 15 by means of a pump or valve connected to a liquid reservoir.

Figure 3A:
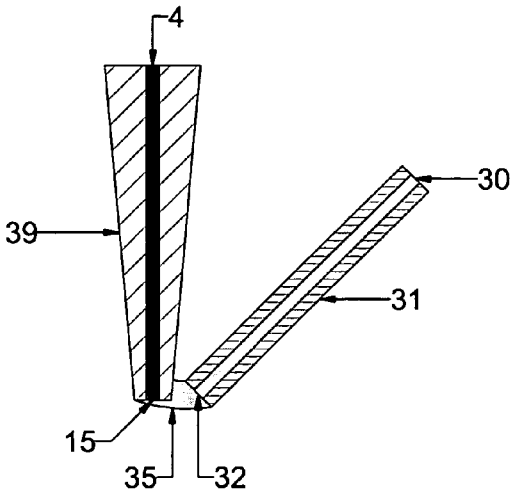
FIG. 3A is a schematic cross-sectional view of an atomizer tip comprising vibrating means with external sealing liquid supply (covered liquid orifice/idle mode).

FIG. 3 is a further embodiment showing the front section of an atomizing device having an ultrasonic horn 39 and a conduit 31 provided adjacent to the ultrasonic horn to supply the sealing liquid 30 during idle time. The ultrasonic horn 39 comprises an inner liquid conduit for the composition to be atomized 4 extending to orifice 15. Sealing liquid 30 is expelled following the spraying cycle through the sealing liquid orifice 32 provided in vicinity to liquid orifice such that liquid orifice 15 is completely covered by film 35, as illustrated in FIG. 3A, and evaporation and solidification of the composition to be atomized 4 is prevented.

Figure 4A:
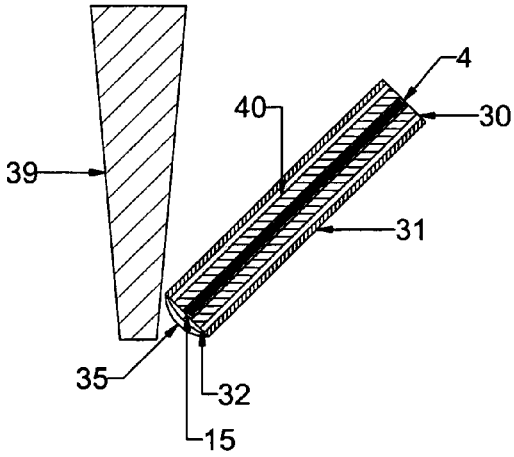
FIG. 4A is a schematic cross-sectional view of an atomizer tip comprising vibrating means with external process and sealing liquid supply (covered liquid orifice/idle mode).

Alternatively as shown in FIG. 4, conduit 31 provided adjacent to the ultrasonic horn may comprise an inner liquid conduit 40 for the composition to be atomized 4 having a first orifice 15 and an outer liquid conduit 31 for the sealing fluid 30 extending to a second orifice 32. The tip of the conduit is located in immediate proximity from the ultrasonic horn tip such that during operation the process liquid exiting from orifice 15 can be atomized by the vibration generated at the horn tip and during idle time a sealing film can be formed covering the process liquid orifice 15 at the tip of the horn. The coaxial arrangement of process liquid orifice 15 and sealing liquid orifice 32 ensures that orifice 15 is completely covered by film 35 such that evaporation of the liquid to be atomized is prevented. Referring to FIG. 4A, during idle time sealing fluid 30 is supplied through orifice 32 to the liquid orifice 15 to cover the liquid orifice 15 completely. The film may extend to the outer surface of the ultrasonic horn such that the area around the liquid orifice 15 is sealed.

Figure 3B:
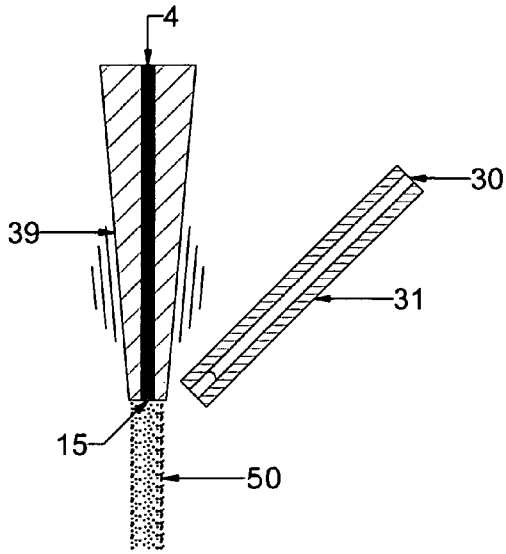
FIG. 3B is a schematic cross-sectional view of an atomizer tip comprising vibrating means with external sealing liquid supply (open liquid orifice/spraying mode).
Figure 4B:
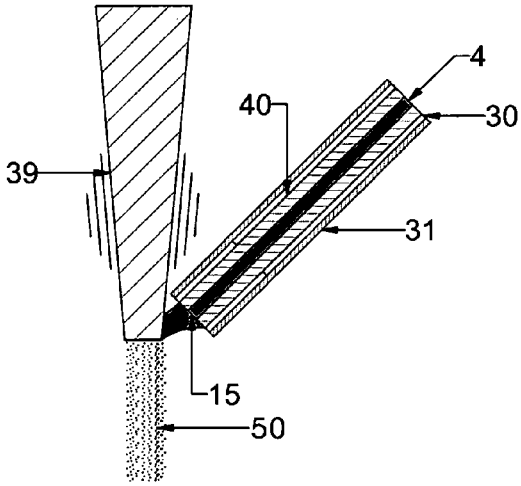
FIG. 4B is a schematic cross-sectional view of an atomizer tip comprising vibrating means with external process and sealing liquid supply (open liquid orifice/spraying mode).

FIGS. 3B and 4B depict the spraying cycle during which process liquid 4 is supplied and disintegrated by vibration of the ultrasonic horn. The process liquid 4 is expelled through orifice 15 and broken-up into fine droplets by vibration, for example at an operation frequency of approximately 130 kHz.

Figure 5A:
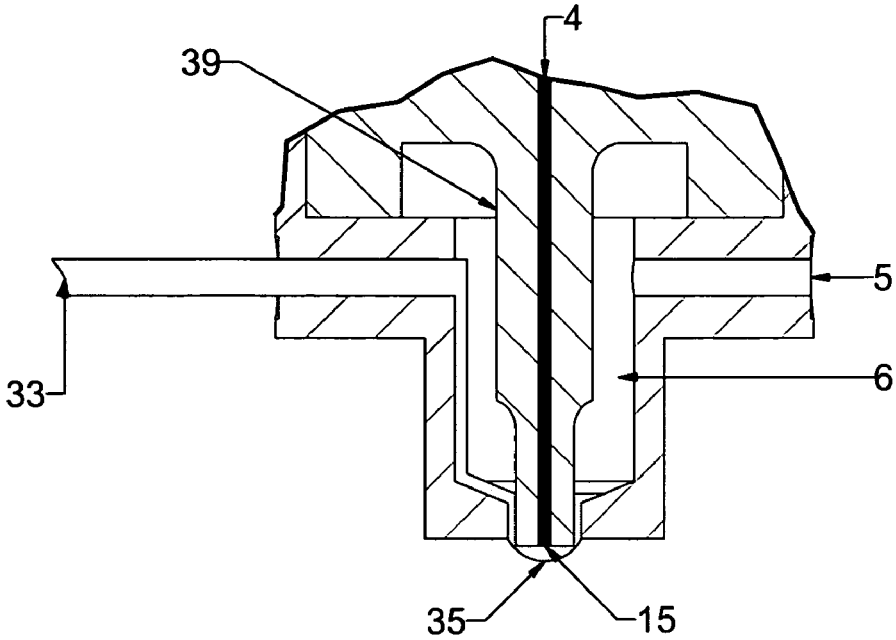
FIG. 5A is a schematic cross-sectional view of an atomizer tip comprising vibrating and pneumatic means (covered liquid orifice/idle mode).
Figure 5B:
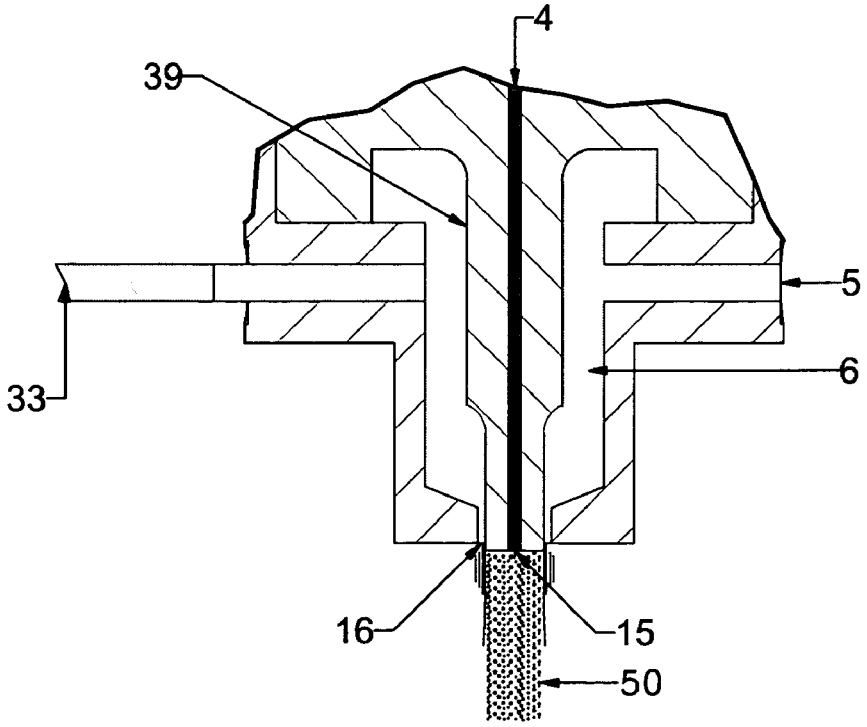
FIG. 5B is a schematic/cross-sectional view of an atomizer tip comprising vibrating and pneumatic means (open liquid orifice/spraying mode).

In another variation shown in FIG. 5, the ultrasonic horn 39 may be surrounded by a body having a gas conduit extending to gas orifice 16 provided adjacent to the ultrasonic horn. A central inner liquid conduit for the composition to be atomized 4 extending from the liquid supply port (not shown) to orifice 15 may be provided within the ultrasonic horn 39. The gas conduit may have a first gas inlet 5 connected to means to supply the gas and a second inlet 33 connected to means to supply the sealing liquid, which may comprise a reservoir. Referring to FIG. 5A, in the state of non-spraying the gas supply is stopped such that sealing liquid can be supplied via inlet 33 into gas conduit 6. The sealing liquid runs through the gas orifice 16 to form a film 35 at the liquid orifice 15. Prior to the next spraying cycle, the sealing liquid is removed. The gas pressure within the gas conduit is increased such that the sealing liquid is forced back into the supply reservoir. The sealing liquid residuals are atomized. With reference to FIG. 5B, process liquid 4 is disintegrated by the ultrasonic waves generated at the tip of the ultrasonic horn when it exits the liquid orifice 15 and a fine spray 50 is obtained. To assist the spraying process gas is fed in the gas inlet 5, flows through gas conduit 6 to the exit end aperture and is expelled through orifice 16.

FIG. 6 is an exemplary embodiment of an atomizing device using electrostatic energy to atomize the process liquid 4. It comprises a liquid conduit extending to liquid orifice 15 and a gas conduit having a first inlet 5 and a second inlet 33 extending to gas orifice 16. The atomizing device is connected via liquid inlet (not shown) to means to supply the liquid to be atomized such as a pump coupled to a supply container, via gas inlet 5 to means to supply the atomizing gas and via additional inlet 33 to means to supply the sealing liquid. A high voltage source 60 is electrically connected to the liquid conduit of the atomizer while portions of the atomizer are electrically isolated from the liquid conduit. The liquid is disintegrated using high voltage. Means for providing a gas stream may be used for carrying the electrically charged droplets to the target, substrate.

Figure 6A:
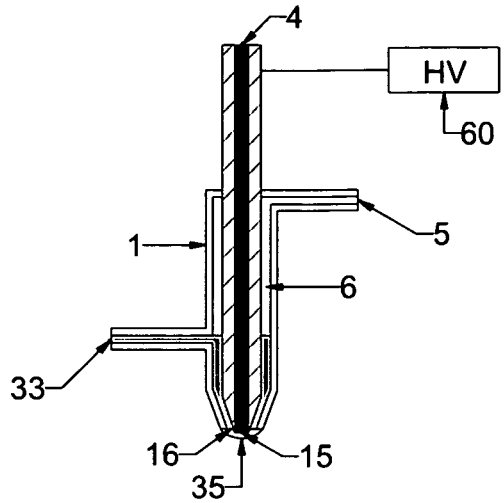
FIG. 6A is a schematic cross-sectional view of an atomizer tip comprising electrostatic means (covered liquid orifice/idle mode).
Figure 6B:
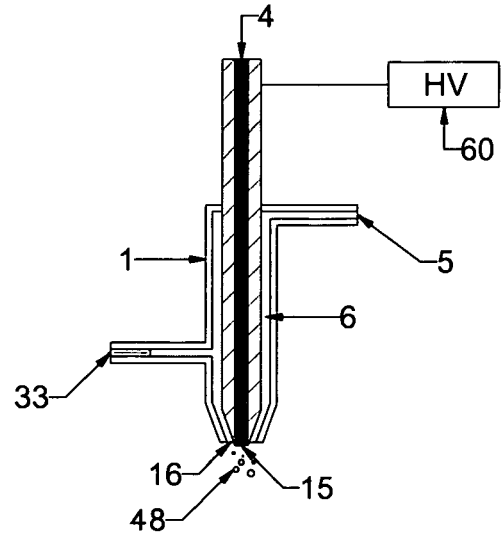
FIG. 6B is a schematic cross-sectional view of an atomizer tip comprising electrostatic means (open liquid orifice/cleaning liquid removal mode).
Figure 6C:
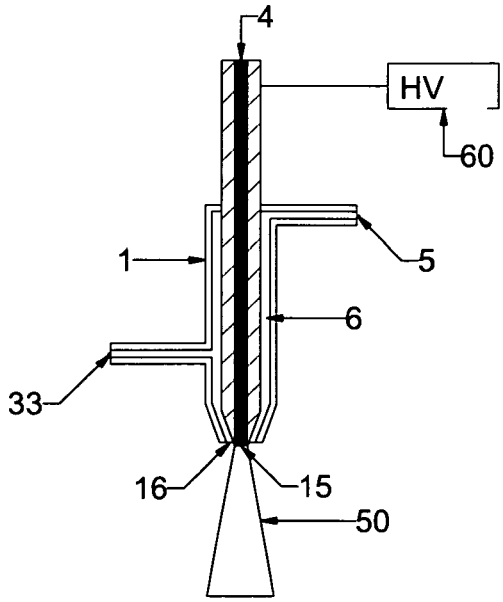
FIG. 6C is a schematic cross-sectional view of an atomizer tip comprising electrostatic means (open liquid orifice/spraying mode).

Referring to FIG. 6A, in the state of non-spraying the gas supply is stopped such that sealing liquid can be supplied via inlet 33 into gas conduit 6. The sealing liquid is expelled through gas orifice 16 to form film 35 at the liquid orifice 15. Prior to the next spraying cycle, the sealing liquid is removed as shown in FIG. 6B. The gas pressure within the gas conduit is increased such that the sealing liquid is forced back into the supply container. The sealing liquid residuals 48 are atomized. FIG. 6C shows the atomizer in the state of spraying. In operation the process liquid 4 is fed in the liquid inlet, atomized by electrically charging the liquid to a very high voltage when it exits the liquid orifice 15 and a fine spray 50 is obtained. A gas sheath, which exits the atomizer at the gas orifice, may also be applied to assist the electrostatic atomization. The droplet carrying gas sheath may provide additional control of the droplet transportation process.

Figure 7A:
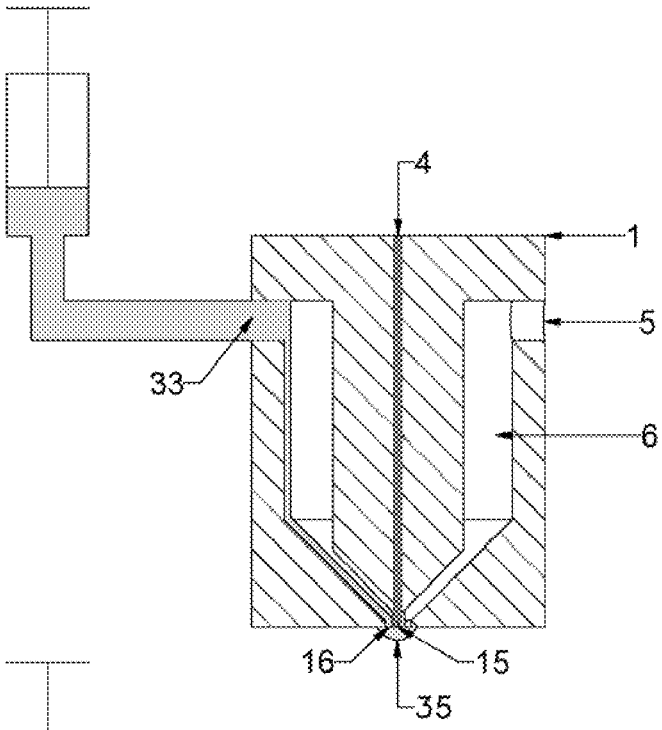
FIG. 7A is a cross-sectional view of a twin-fluid atomizer with sealing liquid supply through gas conduit (covered liquid orifice/idle mode).
Figure 7B:
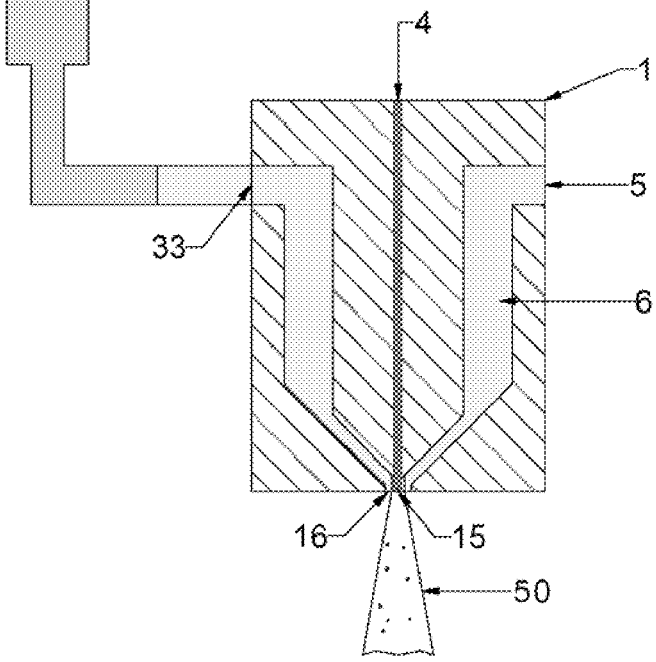
FIG. 7B is a cross-sectional view of a twin-fluid atomizer with sealing liquid supply through gas conduit (open liquid orifice/spraying mode).

FIG. 7 is a further exemplary embodiment of an atomizing device 1 using pneumatic energy to atomize the process liquid 4. It comprises a liquid conduit extending to liquid orifice 15 and a gas conduit 6 having a first 5 and a second inlet 33 extending to gas orifice 16. The atomizing device is connected via liquid inlet to means to supply the liquid 4 to be atomized, via gas inlet 5 to means to supply the atomizing gas and via additional inlet 33 to means to supply the sealing liquid. Alternatively, gas and sealing liquid may be fed into a manifold, which is connected to the gas conduit. The junction may further comprise a valve to separate gas from sealing liquid. Referring to FIG. 7A, in the state of non-spraying the gas supply is stopped such that sealing liquid can be supplied via inlet 33 into gas conduit 6. The sealing liquid is expelled through gas orifice 16 to form film 35 at the liquid orifice 15. Prior to the next spraying cycle the sealing liquid is removed. The gas pressure within the gas conduit is increased such that the sealing liquid is forced back into the supply reservoir and the sealing liquid residuals are atomized. FIG. 7B shows the atomizer in the state of spraying. The process liquid 4 is fed in the liquid inlet (not shown), while the atomizing gas is fed in the gas inlet 5, flows through gas conduit 6 to the exit end aperture and exits the atomizer at the annular gap formed between the liquid 15 and the gas orifice 16. The atomizing gas disintegrates the liquid when it exits the liquid orifice 15 and a fine spray 50 is obtained.

FIG. 8 is an expanded view of the front region of an exemplary atomizing device shown in FIG. 9 below. The atomizer comprises means to control the local environment surrounding the atomizer tip to prevent clogging of the atomizer tip by delivering a sealing liquid to wet the liquid orifice not only during the period of spraying inactivity but also during operation. In this embodiment air is used to atomize the process liquid but is to be understood that other disintegration mechanisms can be applied.

Figure 8A:
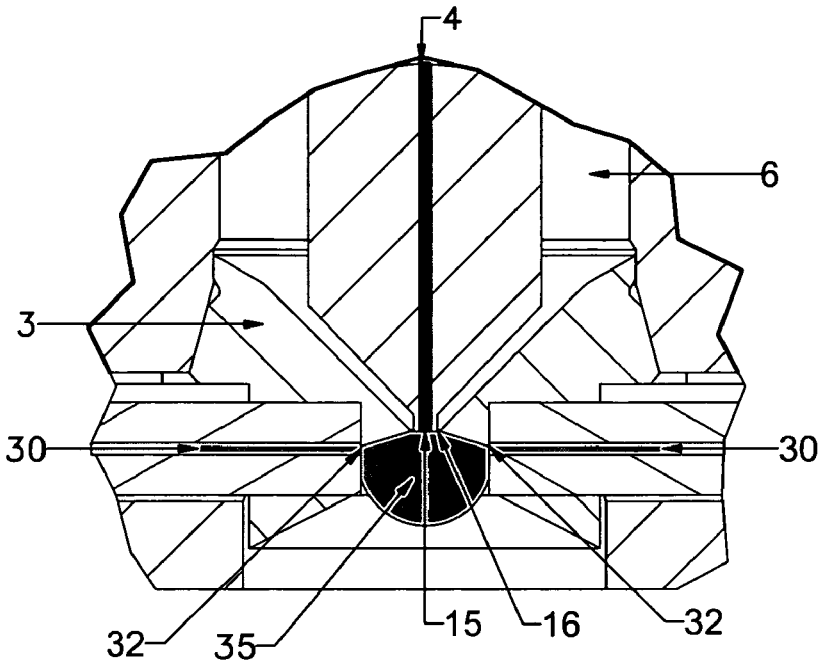
FIG. 8A is a cross-sectional expanded view of a twin-fluid atomizer with sealing liquid supply through two additional liquid conduits (covered liquid orifice/idle mode).
Figure 8B:
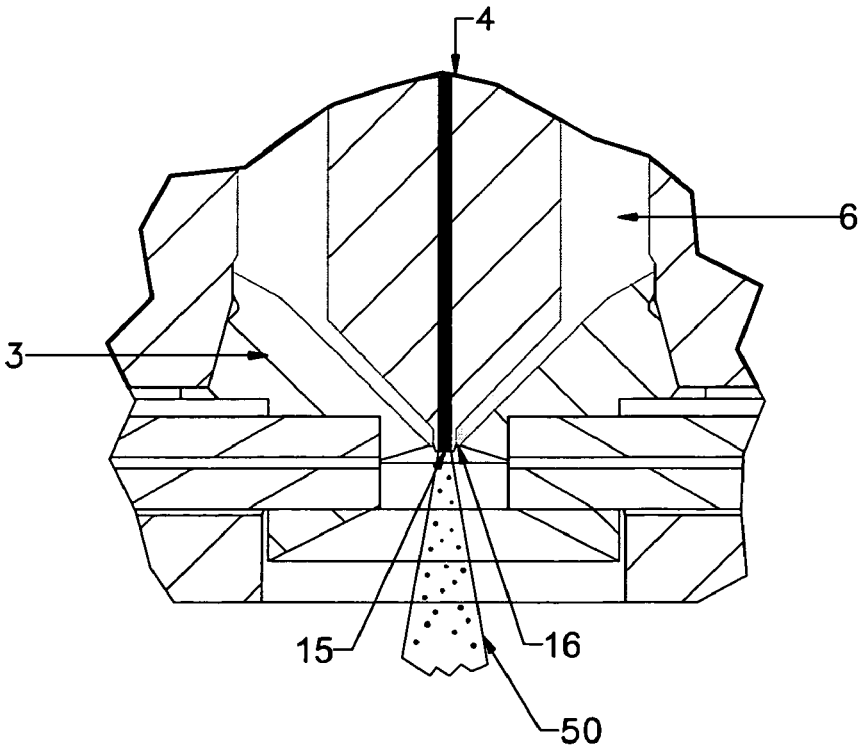
FIG. 8B is a cross-sectional expanded view of a twin-fluid atomizer with sealing liquid supply through two additional liquid conduits (open liquid orifice/spraying mode).
Figure 9:
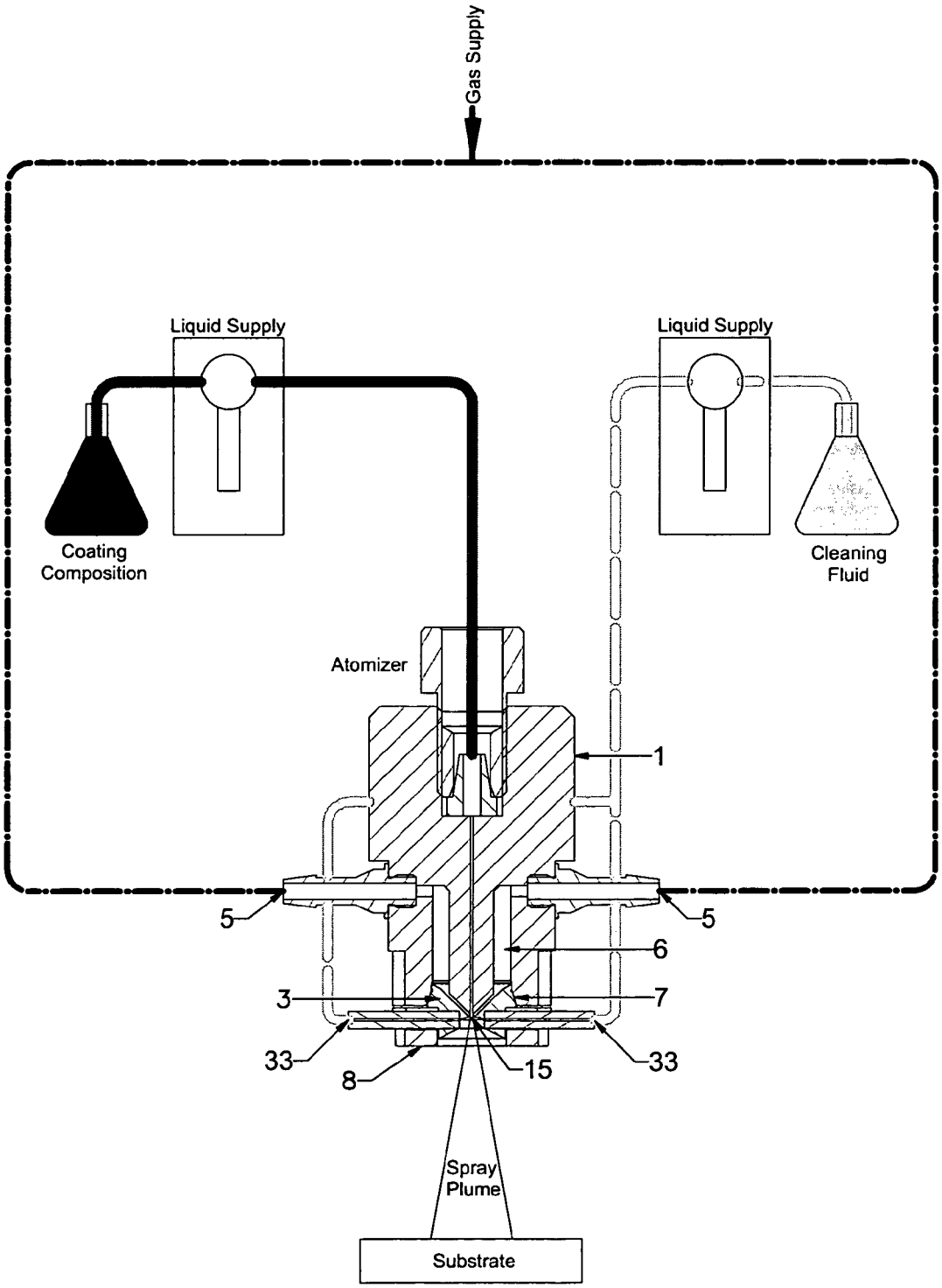
FIG. 9 is a schematic of an exemplary spray coating setup.

Referring to FIG. 8 and FIG. 9, the atomizer comprises a body and a cap 3 being secured to the atomizing end by centering ring 8 and aligned through centering section 7 to permit passage of gas. The body includes a central inner liquid line for the process liquid 4, which extends from the liquid supply port (shown in FIG. 9) to orifice 15. The cap 3 is secured to the atomizing end having a central orifice 16 which provides a small annular gap to permit passage of air therethrough from the gas passages 6. Two additional orifices 32 through which sealing liquid 30 can be supplied are provided within the air cap in immediate vicinity to the atomizer tip such that the air flow is not obstructed Referring to FIG. 8A, in the state of non-spraying sealing liquid is fed into the sealing liquid conduits 30 and expelled via the two orifices 32. The sealing liquid contacts the face of the atomizer tip and forms a capping film 35 covering orifice 15. FIG. 8B shows the state of spraying. The process liquid is fed in the liquid inlet (shown in FIG. 9), while the atomizing gas is fed in the gas inlet (shown in FIG. 9). The gas flows through gas passage 6 extending from a portion substantially coaxial to the liquid line to a conical portion to the exit end aperture and exits the atomizer at the annular gap formed between the liquid orifice 15 and the gas orifice 16. The atomizing gas disintegrates the process liquid 4 when it exits the liquid orifice 15 and a fine spray 50 is obtained.

To prevent solids built-up at the liquid orifice the cleaning liquid 30 may be supplied during the atomization process to continuously wet the nozzle tip.

FIG. 9 is an exemplary coating system, which is described in more detail in the stent coating example below. By way of example, the twin-fluid atomizer of FIG. 8 is used to disintegrate a liquid composition through pressurized gas to produce a spray plume. The atomizer is positioned such that the spray axis of the atomizer is perpendicular to the axis of the substrate and both axes are in the same plane. Atomizer 1 is coupled to means to feed a coating composition or process liquid, sealing liquid and atomizing gas. The coating composition and the sealing liquid are respectively supplied to the atomizer by a syringe pump connected to a fluid reservoir. The spray process is controlled by using a control software programmed in LabView (National Instruments, TX) running on a PC with WIN 2000.

The following example is presented to describe the apparatus and method of the present invention in more detail and to illustrate the advantages of the present invention. The example is not intended in any way otherwise to limit the scope of the disclosure. Stents (manufactured by STI, Israel) having a diameter of 2 mm and a length of 20 mm were mounted on a holding device as described in U.S. Pat. App. No. 60/776,522 incorporated herein as a reference. The atomizer of FIG. 8 was used to disintegrate the coating composition into fine droplets and apply the coating to the stents. Although a twin-fluid atomizer was used in the example, it is to be understood that the principles of the present invention may be applied to other devices including ultrasonic nozzles or dispensing devices as well.

A poly(vinylidene fluoride) PVDF HFP copolymer with a monomer composition of 80% vinylidene fluoride and 10% hexafluoropropylene (Solvay Advanced Polymers, Houston, Tex., USA) was used to coat the stents. The coating solution was prepared by dissolving the polymers in acetone, at five weight percent. Acetone was also used as sealing liquid to cover the liquid orifice during idle times. The sealing liquid supply parameters for film built-up and conservation have been setup to ensure continuous wetting of the liquid orifice during idle time. The atomizer has been aligned in relation to the stent so that the spray axis of the atomizer is perpendicular to the rotation axis of the stent and both axes are in the same plane. It may be positioned at a distance of approximately 12 to 35 mm from the outer surface of the stent.

Referring back to FIG. 9, the atomizer was connected via liquid inlet and two sealing liquid inlets to a coating liquid and a sealing liquid supply source. A syringe pump (Hamilton Inc., Reno, Nev., USA) which was operated at a constant flow rate was used to feed the coating composition from a reservoir to the atomizer. The flow rate of the coating solution may range between 0.5 ml/h and about 50 ml/h and the atomizing pressure between 0.3 bar to about 1.5 bar. A second syringe pump was used to supply the sealing liquid. The flow rate of the sealing liquid is generally between 0.5 ml/h to 20 ml/h depending on the particular process parameters such as length of idle time, sealing liquid type, orifice size and environmental factors.

In operation, liquid was fed at a flow rate of 5 ml/h and at an atomizing pressure of 0.7 bar. Gas was fed with a flow rate of 6.5 l/min and a fine spray is produced. During the application of the coating solution, rotary motion was transmitted to the stent to rotate the stent about its central longitudinal axis. The stent was rotated at 130 rpm and translated along its central longitudinal axis along the atomizer at a translation speed of 0.5 mm/s and moved along the atomizer several times to apply the coating in several passes. Depending on the type of coating solution and process parameters, such as liquid evaporation, it may be desirable to supply a small amount of sealing liquid during the spraying operation to control the local environment around the liquid orifice and prevent solid built-up. Following the coating step, the process liquid supply was stopped and the stent was removed from the spraying area. Next, sealing liquid was fed at an initial flow rate of 20 ml/h to the two sealing liquid inlets until a film of capping liquid was formed covering the process liquid orifice of the atomizer. To maintain the capping liquid film, the flow rate of the sealing liquid (acetone) was decreased to a value of approximately 1 ml/H. Thus, a consistent sealing liquid film lying on the tip of the process liquid orifice and separating the orifice from the external atmosphere was provided.

Before the next spraying cycle, the sealing liquid supply was stopped and the capping film was withdrawn by suction by the syringe pump. To make sure that the sealing liquid is completely removed, gas may be supplied and expelled from the gas orifice to atomize the sealing liquid.

The spray process was started again and the next stent was exposed to the spray plume after ensuring that the atomization process is stable and no fluctuations of the spray plume are visible.

The coating process may be monitored continuously, for example using an Optical Patternator as described in US. Pat. App. No. 60/674,005 incorporated by reference herein. Thus, nozzle built-up or other problems can be detected immediately. In case of fluctuations of the spray pattern and/or flow rate, the coating process may be stopped after completition of the coating cycle and the stent may be removed from the spray area to initiate a cleaning cycle. The nozzle orifice may be wetted with the sealing liquid for a determined period of time and solids built-up at the orifice may by removed by atomizing or withdrawing the sealing liquid with particulate. Thus, in case of solids built-up a loosening and removal of solids can be provided.

It will be anticipated that the success of the method and apparatus of the present invention can be affected by a number of extraneous factors such as ambient air flow, temperature as well as design factors such as the size of the fluid conduit. Further variations in performance will be anticipated from variations in composition and in tubing configuration. In general, variations that tend to increase vaporization of the process liquid, such as increased air flow or temperature, increased atmospheric pressure, or increased solid concentrations will tend to lead to clogging. Conversely, variations that tend to decrease vaporization of the solvent, such as decreased air flow or temperature, decreased atmospheric pressure, or decreased solid concentrations, will tend to prevent clogging of the liquid orifice.

Figure 10:
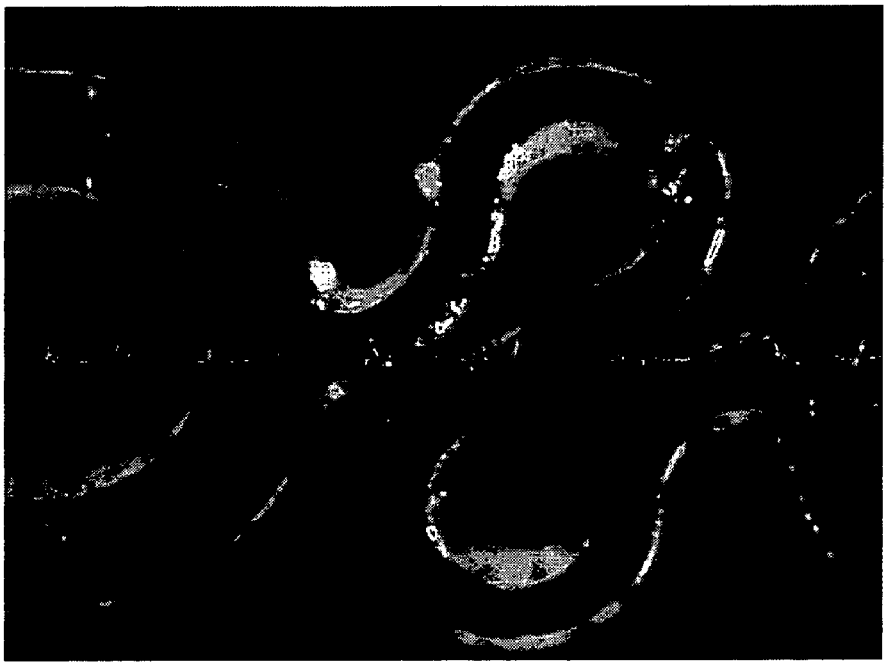
FIG. 10 is a SEM image showing a coating defect on a portion of a stent.

Scanning electron microscope (SEM) images were taken to visualize the surface quality of two exemplary stents. The stent shown in FIG. 10 was coated without covering the orifice during system idle time. Nozzle built-up due to evaporation of the solvent was observed after several spray runs. Coating that has solidified at the orifice became loose, was expelled through the liquid orifice and deposited at the outer surface of the stent as shown in FIG. 10.

Figure 11:
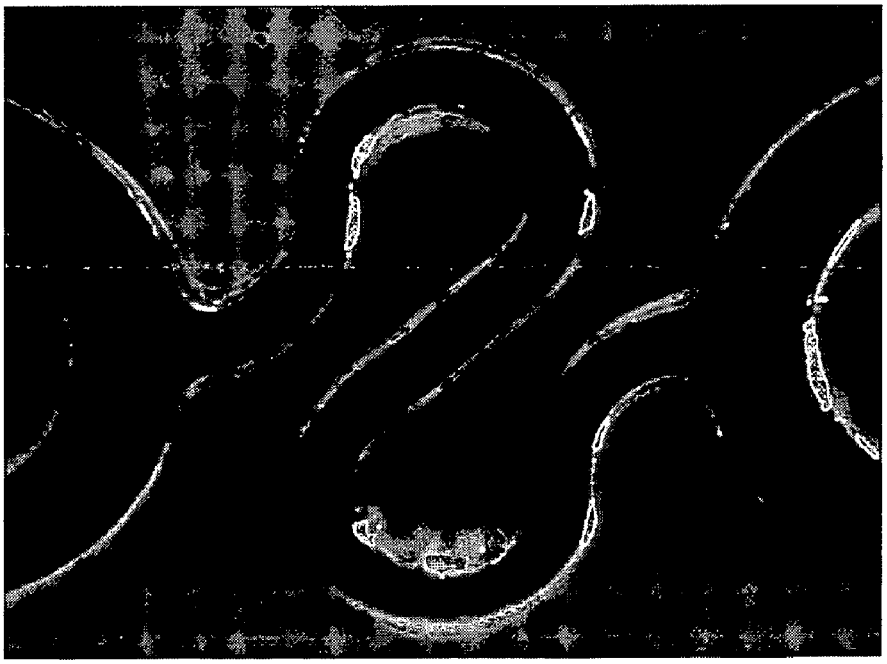
FIG. 11 is a SEM image showing a homogeneous coating of a portion of a stent.

The stent illustrated in FIG. 11 was coated using the method and the apparatus of the present invention described above. The formation of nozzle built-up of formerly suspended particles or dissolved solute could be prevented by means of closing the nozzle aperture when the spraying cycle is stopped. FIG. 11 depicts a portion of the coated stent having a homogeneous coating thickness covering the struts of the stent with a smooth coating layer.

Is has been demonstrated that the operational safety and repeatability of a spraying process can be improved compared to prior art systems by using the apparatus and method of the present invention resulting in cost savings due to improved product quality.

While preferred embodiments of the foregoing invention have been set forth for purposes of illustration, the foregoing description should not be deemed a limitation of the invention herein. Accordingly, various modifications, adaptations and alternatives may occur to one skilled in the art without departing from the spirit and the scope of the present invention.

The invention claimed is:

1. Method to spray a liquid having a tendency to solidify or dry out and to provide a sealing liquid to prevent nozzle clogging, using an apparatus having at least a first orifice for a process liquid and at least a second orifice for a sealing liquid, the sealing liquid orifice being positioned in immediate proximity to the process liquid orifice and the orifices leading directly to the external atmosphere comprising the steps of:

disintegrating the process liquid;

stopping the disintegration process and supplying a sealing liquid to form a film to separate the process liquid orifice from the external atmosphere; and maintaining the film during a period of spraying inactivity.

2. The method according to claim 1, wherein the process liquid is fed into a first liquid conduit extending from a first inlet to said first orifice and the sealing liquid is fed into a second conduit extending to said second orifice.

3. The method according to claim 2, wherein the sealing liquid flows through the second liquid conduit of the apparatus, which surrounds at least partially the first liquid conduit.

4. The method according to claim 2, further comprising a step of feeding an atomizing gas into the second conduit to disintegrate the process liquid.

5. The method of claim 2, further comprising the step of applying a high voltage to the first liquid conduit and disintegrating the liquid using electrostatic means.

6. The method of claim 2, wherein the apparatus further comprises at least a third conduit for an atomizing gas extending from a gas inlet to a gas orifice wherein the sealing liquid orifice is positioned in immediate proximity to the first orifice so that an unobstructed gas flow through the gas orifice is ensured.

7. The method according to claim 6, wherein during spraying activity an amount of sealing liquid is supplied to prevent solids built-up at the process liquid orifice.

8. The method according to claim 1, further comprising a step of removing the sealing liquid by atomization.

9. The method according to claim 1, wherein the sealing liquid is withdrawn by suction.

10. The method according to claim 1, wherein the process liquid comprises a therapeutic substance.

11. The method according to claim 1, further comprising a step of providing during spraying activity a small amount of sealing liquid to prevent solids built-up.

12. The method according to claim 1, further comprising a step of applying the disintegrated process liquid to a substrate to form a coating.

13. The method according to claim 12, wherein the substrate is a medical implant such as a stent.

14. The method according to claim 2, wherein the sealing liquid is removed by suction.

15. The method according to claim 2, wherein the sealing liquid is removed by feeding gas into the second conduit.

16. The method according to claim 2, further comprising a step of drying the spray.

17. The method according to claim 11, wherein the process liquid comprises a polymeric material and a solvent.

18. The method according to claim 1, wherein the sealing liquid is compatible with the process liquid and capable of cleaning the first and/or second orifices.

19. Method to spray a liquid having a tendency to solidify or dry out and to provide a sealing liquid to prevent nozzle clogging, using an apparatus having at least a first orifice for a process liquid and at least a second orifice for a sealing liquid, the sealing liquid orifice being positioned in proximity to the process liquid orifice, comprising the steps of:

feeding the process liquid into a first liquid conduit extending to said first orifice;

feeding an atomizing gas into a second conduit, which extends to said second orifice, to disintegrate the process liquid;

stopping the disintegration process;

supplying the sealing liquid into said second conduit to form a film, which separates the process liquid orifice from the external atmosphere; and maintaining the film during a period of spraying inactivity.

20. The method according to claim 19, further comprising a step of removing the sealing liquid by atomization.

21. The method according to claim 19, wherein the process is used in a medical device spraying application.

* * * * *